US005430984A

United States Patent [19]

Young et al.

[11] Patent Number: 5,430,984

[45] Date of Patent: Jul. 11, 1995

[54] MODULAR WALL CONSTRUCTION UTILIZING WOVEN WIRE PARTITIONS

[75] Inventors: Ronald A. Young; Gregory C. Young, both of Denver, N.C.

[73] Assignee: Wireway South Inc., Denver, N.C.

[21] Appl. No.: 247,061

[22] Filed: May 20, 1994

Related U.S. Application Data

[63] Continuation-in-part of Ser. No. 121,027, Sep. 13, 1993, abandoned.

[51] Int. Cl.[6] ..... E04B 1/00

[52] U.S. Cl. ..... 52/281; 52/282.1; 52/239; 256/24

[58] Field of Search ..... 52/239, 474, 489, 238.1, 52/282.1, 582.1, 580, 764, 281; 160/371; 256/24, 56, 73; 403/262, 263

[56] References Cited

U.S. PATENT DOCUMENTS 4,197,952 4/1980 De Fouw et al. ..... 403/263 X

*Primary Examiner*—Carl D. Friedman
*Assistant Examiner*—Creighton Smith
*Attorney, Agent, or Firm*—Samuels, Gauthier & Stevens

[57] ABSTRACT

A modular wall construction includes a plurality of laterally spaced support posts with at least one panel provided to be arranged between the support posts. One or both of the post and frame of the panel include aligned mutually spaced slots in commonly facing walls thereof, each slot being at least partially defined by oppositely disposed first and second edge segments. Connecting elements are secured to and extend laterally from either the panel or post to overly the walls of the adjacent post or panel and the respective slots. The connecting elements include hook shaped portions which are received in the slots in engagement with the first edge segments, and have openings therein aligned with the slots adjacent to the second edge segments thereof. Fasteners extend through the openings into the slots to coact in engagement with the second edge segments to prevent disengagement of the hook portions from the first edge segments.

39 Claims, 5 Drawing Sheets

MODULAR WALL CONSTRUCTION UTILIZING WOVEN WIRE PARTITIONS

This application is a continuation-in-part of application No. 08/121,026 filed Sep. 13, 1993 now abandoned.

BACKGROUND OF THE INVENTION

The invention relates to a wall construction for modular woven wire partitions.

Modular woven wire partitions are conventionally made up of individual rectangular panels arranged vertically one above the other as well as side by side in a horizontally adjacent relationship. During erection, the horizontally adjacent panels are bolted together. This is an extremely time consuming operation which adds significantly to the overall cost of an installation.

A particularly convenient modular wall construction is described in U.S. Pat. No. 4,794,744 entitled "Wall Construction for Modular Woven Wire Partition", and incorporated herein by reference. This patent describes a wall construction for a modular woven wire partition including a plurality of panels arranged vertically in a coplanar relationship between a plurality of laterally spaced vertically disposed fixed support posts. Each of the support posts includes a plurality of vertically spaced openings for receiving ear end tab connector elements associated with the panels. The connector elements are engageable with the openings to thereby connect the panels to the support posts. Each successive connected panel prevents a lower panel from being removed from the support post. The top most vertically disposed panel includes a keeper plate or extensions associated with the support posts for preventing lifting and removal of the uppermost panels, thus safeguarding the wall structure against unauthorized disassembly.

A primary objective of the present invention is to provide an improved means of individually securing each of the vertically arranged panels in place, thereby obviating reliance on securance of the uppermost panels as the sole means of thwarting unauthorized disassembly. Furthermore, it is an object of the present invention to provide a modular construction in which each of the panels may be rapidly secured between support posts in a simple straight-forward manner.

SUMMARY OF THE INVENTION

The modular wall construction of the present invention includes a plurality of laterally spaced support posts with at least one panel adapted to be arranged therebetween. One or both of the posts and frame of the panel include aligned mutually spaced slots in commonly facing walls thereof, each slot being at least partially defined by oppositely disposed first and second edge segments. Connecting elements are secured to and extend laterally from either the panel or post to overlie the walls of the adjacent post or panel and the respective slots. The connecting elements include hook shaped portions which are received in the slots in engagement with the first edge segments, and have openings therein aligned with the slots adjacent to the second edge segments thereof. Fasteners extend through the openings into the slots to coact in engagement with the second edge segments to prevent disengagement of the hook portions from the first edge segments.

DETAILED DESCRIPTION OF THE ILLUSTRATED EMBODIMENTS

Figure 1:
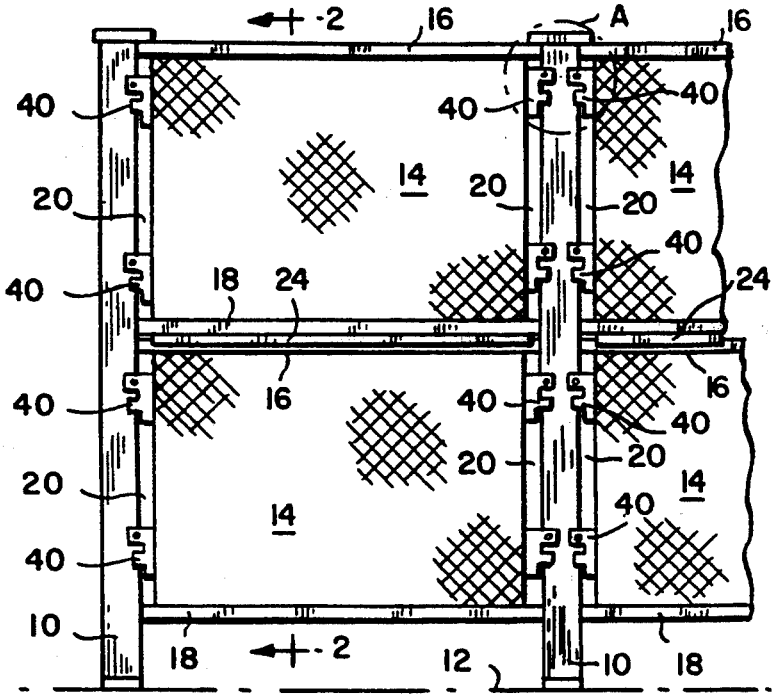
FIG. 1 is an exterior elevational view of a portion of a wall construction in accordance with the present invention.
Figure 2:
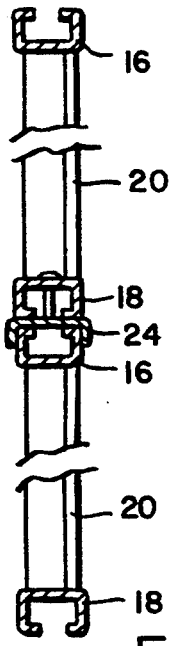
FIG. 2 is a sectional view taken along line 2—2 of FIG. 1.

Referring initially to FIGS. 1 and 2, a modular woven wire partition having a wall construction in accordance with the present invention is shown comprising a plurality of laterally spaced vertically disposed support posts 10 fixed to the floor 12 by any convenient means, typically by anchor bolts or the like (not shown). A plurality of panels 14 are arranged vertically in a coplanar relationship between the support posts. The number of panels may vary widely, depending on the desired height of the partition. In the example provided, two panels are shown vertically arranged for illustrative purposes.

Each panel 14 has a rectangular configuration bordered by top 16, bottom 18 and side frame members 20. Woven wire screening is stretched between and secured to the frame members. At least the top and bottom frame members 16, 18 are provided with generally channel-shaped cross sections. All but the lowermost vertically arranged panels have a channel-shaped cap 24 secured to the underside of their bottom frame members 18. Accordingly, the caps 24 are seated on the top frame members 16 of lower displaced panels such that the caps 24 overlap the sides of the underlying top frame member.

Figure 3:
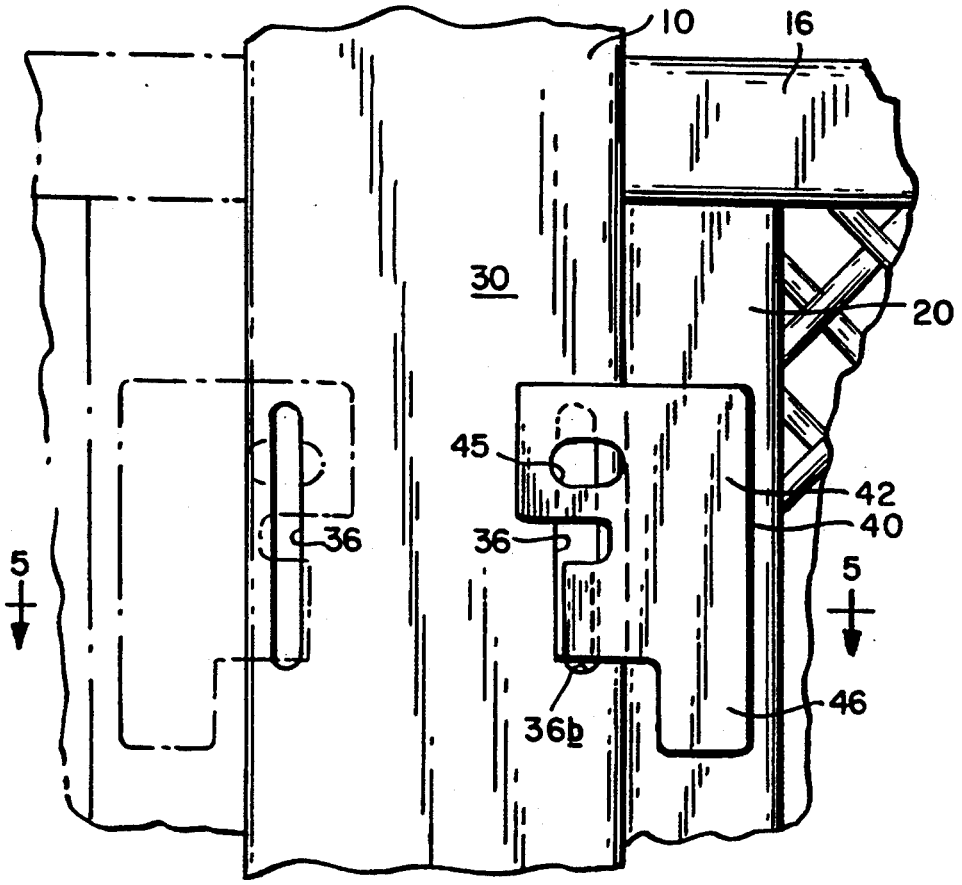
FIG. 3 is an enlarged view of the circled area designated "A" in FIG. 1.
Figure 5:
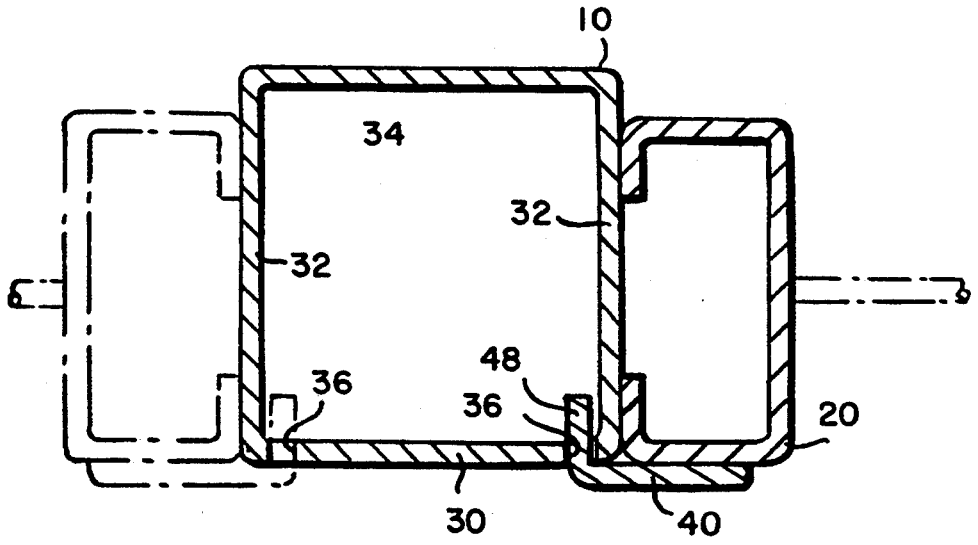
FIG. 5 is a horizontal sectional view taken along line 5—5 of FIG. 3.
Figure 4:
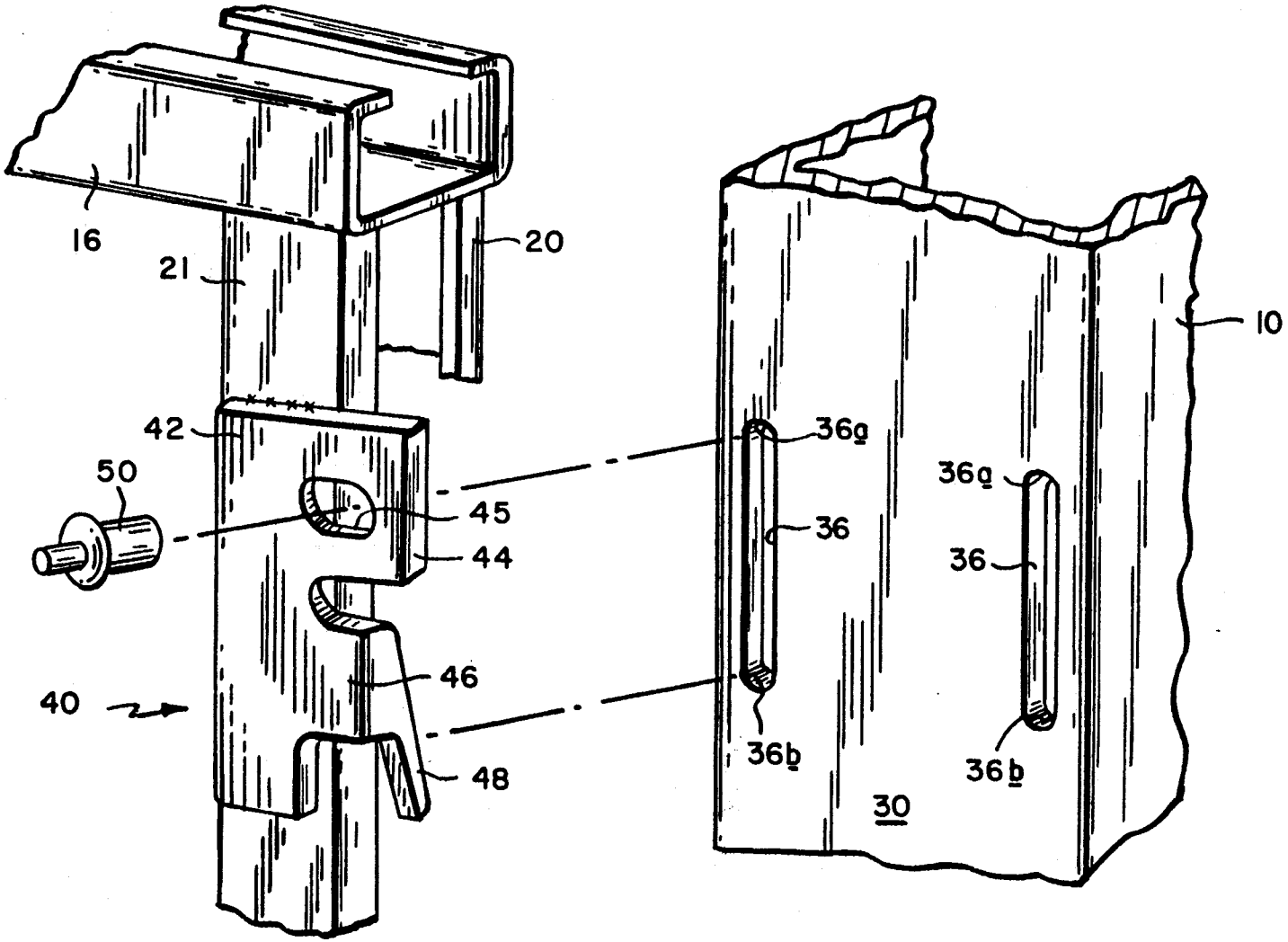
FIG. 4 is an enlarged perspective view of a connector element and a support post prior to assembly.

With reference now to FIGS. 3–5, each support post 10 preferably comprises a hollow box beam with a front (or rear) mounting surface 30 and with side surfaces 32 extending rearwardly from the mounting surface to a rear surface 34. Each front mounting surface 30 has a plurality of vertically spaced pairs of openings 36 provided at opposite edges of the mounting surface adjacent to the surfaces 32. Each opening has a top edge segment **36*a* and a bottom edge segment 36*b*. The openings 36 are preferably disposed adjacent the side surfaces 32** to provide support for accommodating hole punching of the tubular post without crushing the post.

This process thus allows the walls of the posts to be relatively thinner than might otherwise be the case if the openings would be punched in a central area of the mounting surface 30.

As can best be seen in FIG. 4, a connector element 40 is adapted to be secured to the side frame member 20. The connector element 40 includes a face plate 42 which is attached in a conventional manner, e.g. welding, to a frontal surface 21 of the side frame member 20. The face plate 42 has an integral flange member 44 with a through hole 45. A second flange member 46 terminates in an integral perpendicular tab 48 which extends downwardly to form a hook. It will be appreciated that equivalent connector elements 40 are approximately disposed in each corner of the panel 14, and that the hook and through hole are arranged in parallel with respect to the support posts.

The method of assembling the wall construction is now described. A panel member 14 is positioned between the support posts 10, with the flange members 44, 46 overlapping the front mounting surface 30, and with the tab 48 located within the respective opening 36. The panel is then dropped relative to the support post, thereby allowing the tab 48 to descend behind the bottom edge segment **36*b* of the opening 36 to establish a firmly interlocked relationship behind the mounting surface 30. At the same time, the through hole 45 of the flange 44 becomes aligned with the top edge segment 36*a*** of the opening.

At this point, and with reference to FIG. 4, a fastener 50, such as a drive-pin fastener or tamper resistant screw, is inserted through the through hole 45 and becomes engaged with the top edge segment **36*a*. Thus, the interaction between the fastener 50 with the top edge segment 36*a* and the interaction between the tab 48 with the bottom edge segment 36*b* and the inner part of the mounting surface 30 prevents the connector element 40 from being removed from the opening 36. Accordingly, the panel 14 is securely connected to the support posts 10** in a secure manner without the need for welding.

Figure 6:
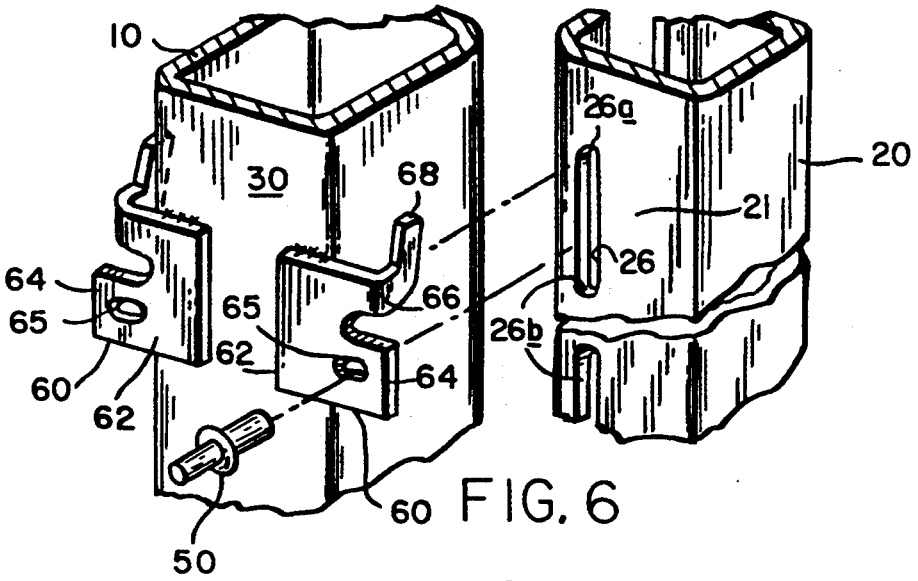
FIG. 6 is an enlarged perspective view of a connector element and a support post prior to assembly according to an alternative embodiment of the present invention.

An alternative embodiment of the present invention is illustrated in FIG. 6, wherein each front mounting surface 21 of the side frame member 20 has a plurality of vertically spaced pairs of openings 26 provided at the edge of the mounting surface. Each opening has a top edge segment **26*a* and a bottom edge segment 26*b*. The openings 26 are preferably disposed adjacent the side edge of surface 21 to provide support for accommodating hole punching of the frame member without crushing it. This process thus allows the walls of the frames to be relatively thinner than those cases where the openings would be punched in a central area of the mounting surface 21**.

As can be seen in FIG. 6, a connector element 60 is adapted to be assembled onto the mounting surface 30 of the post 10. The connector element 61 includes a face plate 62 which is connected in a conventional manner, e.g. welding, to the mounting surface 30. The face plate 62 has an integral flange member 64 with a through hole 65. A second flange member 66 terminates in an integral perpendicular tab 68 which extends upwardly to form a hook.

The method of assembling the wall construction is now described. A panel member 14 is positioned between the support posts 10, with the flange members 64 and 66 overlapping the front mounting surface 21, and with the tab 68 located within the respective opening 26. The panel is then dropped relative to the support post, thereby allowing the tab 68 to coact with the top edge segment **26*a* of the opening 26 to establish a firmly interlocked relationship behind the mounting surface 21. At the same time, the through hole 65 of the flange 64 becomes aligned with the bottom edge segment 26*b* of the opening 26**.

The fastener 50 is inserted through the through hole 65 and becomes engaged with the bottom edge segment **26*b*. Thus, the interaction between the fastener 50 with the bottom edge segment 26*b*, and the interaction between the tab 68 with the top edge segment 26*a* and the inner part of the mounting surface 21, prevent the connector element 60 from being removed from the opening 26. Accordingly, the panel 14 is securely connected to the support posts 10**.

Figure 7:
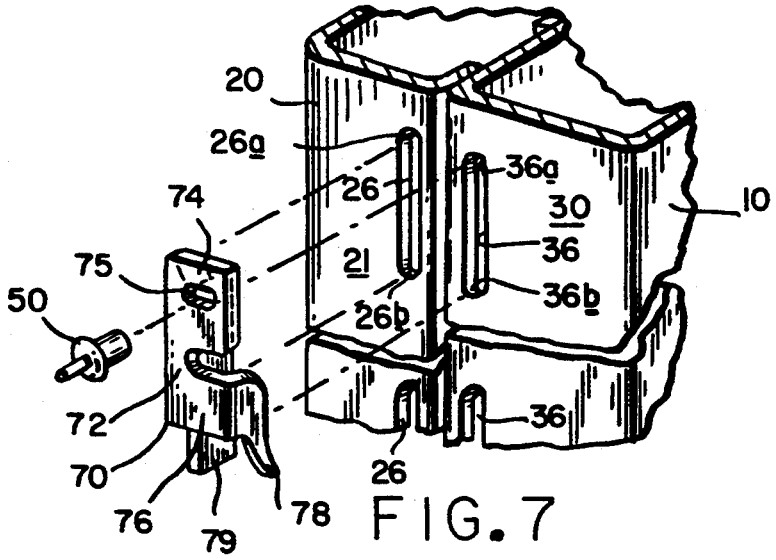
FIG. 7 is an enlarged perspective view of a connector element and a support post prior to assembly according to a second alternative embodiment of the present invention.

FIG. 7 shows another alternative embodiment of the present invention, wherein both the posts 10 and the side frame members 20 include respective openings 36 and 26. A connector element 70 includes a face plate 72 having an integral flange member 74 with a through hole 75, a second flange member 76 terminating in an integral perpendicular tab 78 which extends downwardly to form a hook, and an integral perpendicular third flange member 79. During assembly, a panel member 14 is positioned between the support posts 10 so that openings 26 and 36 are adjacent one another. The connector element 70 is then coupled to the side frame member 20 by inserting the flange 79 within the opening 26.

Thereafter, the flange members 74 and 76 are positioned to overlap the front mounting surface 30 of the post 10 so that the tab 78 is located within the opening 36. The panel is then dropped relative to the support post, thereby allowing the tab 78 to coact with the bottom edge segment **36*b* of the opening 36 to establish a firmly interlocked relationship behind the mounting surface 30, and allowing the flange 79 to establish a firmly interlocked relationship behind the surface 21. At the same time, the through hole 75 of the flange 74 becomes aligned with the top edge segment 36*a* of the opening 36. The fastener 50 is inserted through the through hole 75 and becomes engaged with the top edge segment 36*a*. Thus, the interaction between the fastener 50 with the top edge segment 36*a* and the interaction between the tab 78 with the bottom edge segment 36*b* and the inner part of the mounting surface 30, and the further interaction between the flange 79 with the inner part of surface 21, prevent the connector element 70 from being removed. Accordingly, the panel 14 is securely connected to the support posts 10**.

Figure 8:
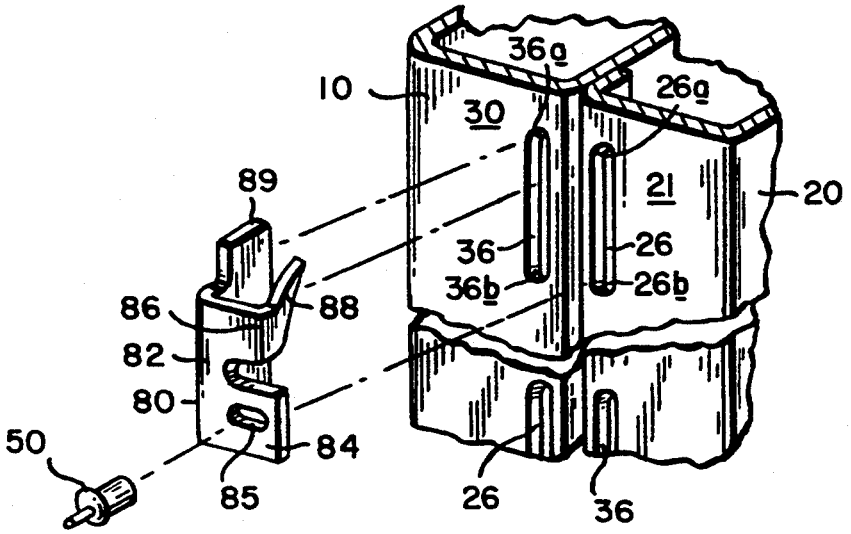
FIG. 8 is an enlarged perspective view of a connector element and a support post prior to assembly according to a third alternative embodiment of the present invention.

FIG. 8 shows yet another alternative embodiment of the present invention, wherein again both the posts 10 and the side frame members 20 include respective openings 36 and 26. A connector element 80 includes a face plate 82 having an integral flange member 84 with a through hole 85, a second flange member 86 terminating in an integral perpendicular tab 88 which extends upwardly to form a hook, and an integral perpendicular third flange member 89. During assembly, a panel member 14 is positioned between the support posts 10 so that openings 26 and 36 are adjacent one another. The connector element 80 is then coupled to the post 10 by inserting the flange 89 within the opening 36.

Thereafter, the flange members 84 and 86 are positioned to overlap the front mounting surface 21 of the frame 20 so that the tab 88 is located within the opening 26. The panel is then dropped relative to the support post, thereby allowing the tab 88 to coact with the top edge segment 26*a* to establish a firmly interlocked relationship behind the mounting surface 21, and allowing the flange 89 to establish a firmly interlocked relationship behind the surface 30. At the same time, the through hole 85 of the flange 84 becomes aligned with the bottom edge segment 26*b* of the opening 26. The fastener 50 is inserted through the through hole 85 and becomes engaged with the bottom edge segment 26*b*. Thus, the interaction between the fastener 50 with the bottom edge segment 26*b* and the interaction between the tab 88 with the top edge segment 26*a* and the inner part of the mounting surface 21, and the further interaction between the flange 89 with the inner part of surface 30, prevent the connector element 80 from being removed. Accordingly, the panel 14 is securely connected to the support posts 10.

Figure 9A:
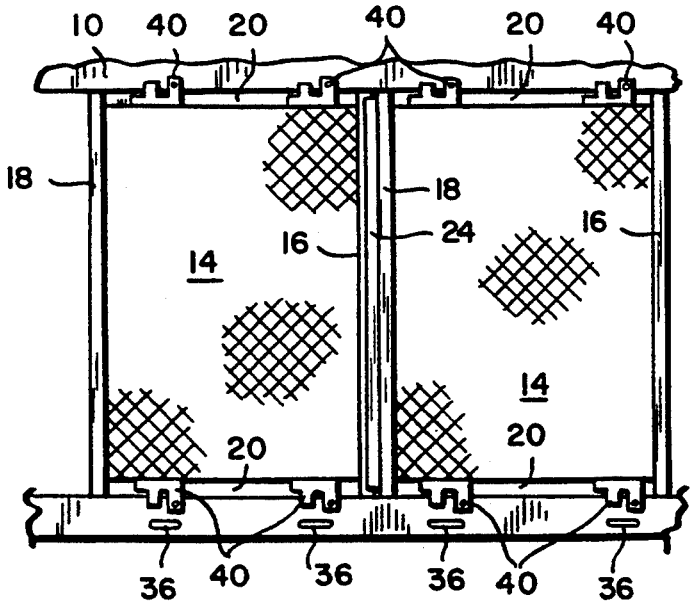
FIG. 9A is an exterior elevational view of a portion of a wall construction and a horizontal configuration.
Figure 9B:
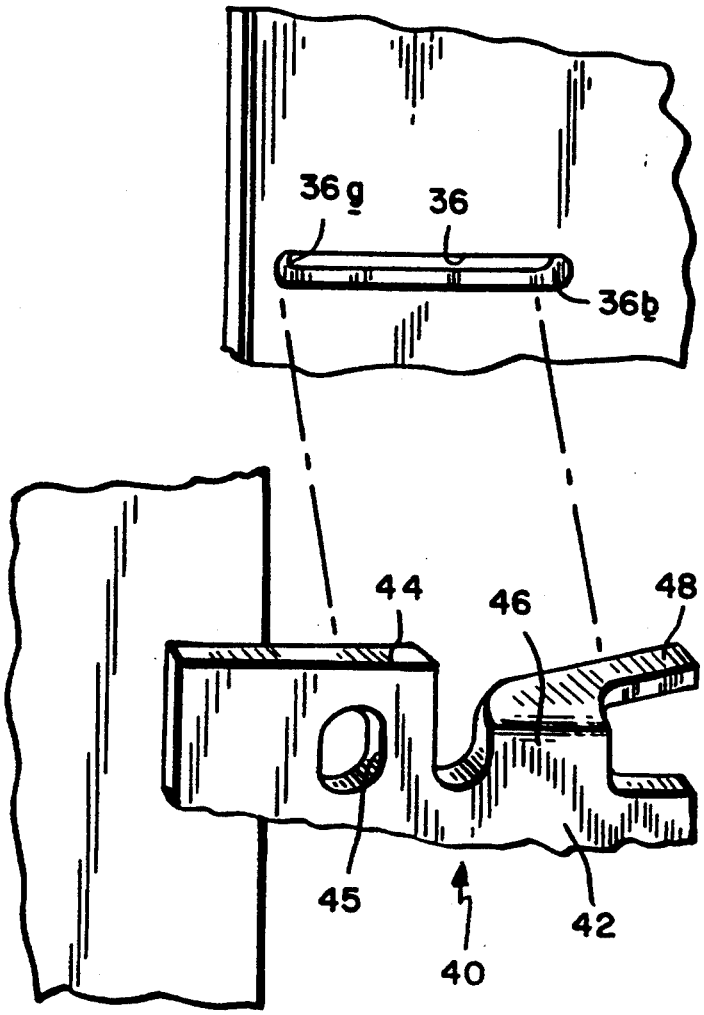
FIG. 9B is an enlarged partially cutaway perspective view of a connector element and a support post prior to assembly.

It will be appreciated by those of skill in the art that several modifications to the illustrated embodiment are possible. For example, the panels 14 and support posts 10 may be disposed in a horizontal manner to provide a top or roof portion for the modular wall construction. In addition, the openings 26,36 and the illustrated connector elements 40,60,70,80 may be configured in a horizontal manner, rather than the illustrated vertical configuration, in both vertical and horizontal modular constructions, as shown in FIG. 9A. FIG. 9B shows an arrangement in which the hook and opening in the hook and through hole are arranged perpendicularly wit respect to the support post.

The foregoing description has been set forth to illustrate the invention and is not intended to be limiting. Since further modifications of the described embodiments incorporating the spirit and substance of the invention may occur to persons skilled in the art, the scope of the invention should be limited solely with reference to the appended claims and equivalents thereof.

What is claimed is:

1. A modular wall construction comprising:

a plurality of laterally spaced support posts having mutually spaced slots in commonly facing walls thereof, each slot being at least partially defined by oppositely disposed first and second edge segments;

at least one panel arranged between said support posts;

connecting elements secured to and extending laterally from said panel to overlie the commonly facing walls of said support posts at said slots, said connecting elements having hook shaped portions received in said slots in engagement with the first edge segments thereof, and having openings therein aligned with said slots adjacent to the second edge segments thereof; and fastening means extending through said openings into said slots to coact in engagement with said second edge segments to prevent disengagement of said hook portions from said first edge segments.

2. The modular wall construction of claim 1, wherein said support posts are tubular and have a rectangular cross sectional configuration, with side walls extending rearwardly from a front wall to a rear wall, said slots being located at the junctures of said front and side walls.

3. The modular wall construction of claim 1, wherein said support posts and said panel are vertically arranged.

4. The modular wall construction of claim 1, wherein said support posts and said panel are horizontally arranged.

5. The modular wall construction of claim 1, wherein said slots extend vertically.

6. The modular wall construction of claim 1, wherein said slots extend horizontally.

7. The modular wall construction of claim 1, wherein said connecting elements include upper and lower flanges, said lower flanges being bent rearwardly to define said hook shaped portions, and said upper flanges being arranged to overlie said front walls and having said openings extending therethrough.

8. The modular wall construction of claim 7, wherein said openings and said hooked shaped portions are arranged in parallel with respect to said support posts.

9. The modular wall construction of claim 7, wherein said openings and said hooked shaped portions are arranged perpendicularly with respect to said support posts.

10. The modular wall construction of claim 1, wherein said fastening means comprise pin members which coact in engagement with the edges of said openings to resist subsequent removal thereof.

11. A modular wall construction comprising:

a plurality of laterally spaced support posts;

at least one panel arranged between said support posts, said panel having mutually spaced slots in commonly facing walls thereof, each slot being at least partially defined by oppositely disposed first and second edge segments;

connecting elements secured to and extending laterally from said support posts to overlie the commonly facing walls of said panel at said slots, said connecting elements having hook shaped portions received in said slots in engagement with the first edge segments thereof, and having openings therein aligned with said slots adjacent to the second edge segments thereof; and fastening means extending through said openings into said slots to coact in engagement with said second edge segments to prevent disengagement of said hook portions from said first edge segments.

12. The modular wall construction of claim 11, wherein said support posts and said panel are vertically arranged.

13. The modular wall construction of claim 11, wherein said support posts and said panel are horizontally arranged.

14. The modular wall construction of claim 11, wherein said slots extend vertically.

15. The modular wall construction of claim 11, wherein said slots extend horizontally.

16. The modular wall construction of claim 11, wherein said connecting elements include upper and lower flanges, said upper flanges being bent rearwardly to define said hook shaped portions, and said lower flanges being arranged to overlie said commonly facing walls and having said openings extending therethrough.

17. The modular wall construction of claim 16, wherein said openings and said hooked shaped portions are arranged in parallel with respect to said panel.

18. The modular wall construction of claim 16, wherein said openings and said hooked shaped portions are arranged perpendicularly with respect to said panel.

19. The modular wall construction of claim 11, wherein said fastening means comprise pin members which coact in engagement with the edges of said openings to resist subsequent removal thereof.

20. A modular wall construction comprising:

a plurality of laterally spaced support posts having mutually spaced first slots in commonly facing walls thereof, each first slot being at least partially defined by oppositely disposed first and second edge segments;

at least one panel arranged between said support posts, said panel having mutually spaced second slots in commonly facing walls thereof, each second slot being at least partially defined by oppositely disposed third and fourth edge segments;

connecting elements having first hooked shaped portions received and secured within said second slots in engagement with said third and fourth edge segments thereof so as to extend laterally from said panel to overlie the commonly facing walls of said support posts at said first slots, said connecting elements further having second hook shaped portions received in said first slots in engagement with the first edge segments thereof, and having openings therein aligned with said first slots adjacent to the second edge segments thereof; and fastening means extending through said openings into said first slots to coact in engagement with said second edge segments to prevent disengagement of said second hook portions from said first edge segments.

21. The modular wall construction of claim 20, wherein said support posts are tubular and have a rectangular cross sectional configuration, with side walls extending rearwardly from a front wall to a rear wall, said first slots being located at the junctures of said front and side walls.

22. The modular wall construction of claim 20, wherein said support posts and said panel are vertically arranged.

23. The modular wall construction of claim 20, wherein said support posts and said panel are horizontally arranged.

24. The modular wall construction of claim 20, wherein said first and second slots extend vertically.

25. The modular wall construction of claim 20, wherein said first and second slots extend horizontally.

26. The modular wall construction of claim 20, wherein said connecting elements include first, second and third flanges, said first flanges being bent rearwardly to define said first hook shaped portions, said second flanges being arranged to overlie said commonly facing walls and having said openings extending therethrough, and said third flanges being bent rearwardly to define said second hook shaped portions.

27. The modular wall construction of claim 26, wherein said openings and said second hooked shaped portions are arranged in parallel with respect to said support posts.

28. The modular wall construction of claim 26, wherein said openings and said second hooked shaped portions are arranged perpendicularly with respect to said support posts.

29. The modular wall construction of claim 20, wherein said fastening means comprise pin members which coact in engagement with the edges of said openings to resist subsequent removal thereof.

30. A modular wall construction comprising:

a plurality of laterally spaced support posts having mutually spaced first slots in commonly facing walls thereof, each first slot being at least partially defined by oppositely disposed first and second edge segments;

at least one panel arranged between said support posts, said panel having mutually spaced second slots in commonly facing walls thereof, each second slot being at least partially defined by oppositely disposed third and fourth edge segments;

connecting elements having first hooked shaped portions received and secured within said first slots in engagement with said first and second edge segments thereof so as to extend laterally from said support posts to overlie the commonly facing walls of said panel at said second slots, said connecting elements further having second hook shaped portions received in said second slots in engagement with the third edge segments thereof, and having openings therein aligned with said second slots adjacent to the fourth edge segments thereof; and fastening means extending through said openings into said second slots to coact in engagement with said fourth edge segments to prevent disengagement of said second hook portions from said third edge segments.

31. The modular wall construction of claim 30, wherein said support posts are tubular and have a rectangular cross sectional configuration, with side walls extending rearwardly from a front wall to a rear wall, said first slots being located at the junctures of said front and side walls.

32. The modular wall construction of claim 30, wherein said support posts and said panel are vertically arranged.

33. The modular wall construction of claim 30, wherein said support posts and said panel are horizontally arranged.

34. The modular wall construction of claim 30, wherein said first and second slots extend vertically.

35. The modular wall construction of claim 30, wherein said first and second slots extend horizontally.

36. The modular wall construction of claim 30, wherein said connecting elements include first, second and third flanges, said first flanges being bent rearwardly to define said first hook shaped portions, said second flanges being arranged to overlie said commonly facing walls and having said openings extending therethrough, and said third flanges being bent rearwardly to define said second hook shaped portions.

37. The modular wall construction of claim 36, wherein said openings and said second hooked shaped portions are arranged in parallel with respect to said panel.

38. The modular wall construction of claim 36, wherein said openings and said second hooked shaped portions are arranged perpendicularly with respect to said panel.

39. The modular wall construction of claim 30, wherein said fastening means comprise pin members which coact in engagement with the edges of said openings to resist subsequent removal thereof.

* * * * *